US006036553A

United States Patent [19]

Seko et al.

[11] Patent Number: 6,036,553

[45] Date of Patent: Mar. 14, 2000

[54] CONNECTOR PROVIDED WITH A RETAINER

[75] Inventors: Satomi Seko; Masamitsu Chishima, both of Yokkaichi, Japan

[73] Assignee: Sumitomo Wiring Systems, Ltd., Japan

[21] Appl. No.: 09/153,961

[22] Filed: Sep. 16, 1998

[30] Foreign Application Priority Data

Sep. 17, 1997 [JP] Japan ..... 9-251776

[51] Int. Cl.[7] ..... H01R 13/434

[52] U.S. Cl. ..... 439/752

[58] Field of Search ..... 439/752, 595

[56] References Cited

U.S. PATENT DOCUMENTS

| | | | |
|---|---|---|---|
| 5,437,565 | 8/1995 | Atsumi et al. | 439/752 |
| 5,647,776 | 7/1997 | Duclos et al. | 439/752 |
| 5,772,478 | 6/1998 | Kuempel et al. | 439/752 |

FOREIGN PATENT DOCUMENTS

| | | |
|---|---|---|
| 0 356 251 | 1/1990 | European Pat. Off. . |
| 5-23455 | 1/1993 | Japan . |
| 8-250215 | 1/1996 | Japan . |

*Primary Examiner*—Gary Paumen

*Attorney, Agent, or Firm*—Antony J. Casella; Gerald E. Hespos

[57] ABSTRACT

A connector is provided with a retainer 30 that is rotatable in a housing 10 about an insertion portion 33. When the retainer 30 is rotated to its lock position, lock projections 32 provided on the insertion portion 33 lock the terminal fittings 20. Since the retainer 30 can directly lock the terminal fittings 20 in this connector, the terminal fittings 20 can be retained with a strong force. Further, since a retainer insertion hole 31 is formed in the front surface of the housing 10, it is not exposed to the outside by being covered by a mating connector. In other words, the inventive connector has advantages of both side retainer type and front retainer type connectors of prior art and retains the terminal fittings 20 with a large force while being designed to be watertight.

10 Claims, 7 Drawing Sheets

CONNECTOR PROVIDED WITH A RETAINER

BACKGROUND OF THE INVENTION

1. Field of the Invention

The present invention relates to a connector provided with a retainer.

2. Description of the Prior Art

Generally, there are two types of connectors provided with a retainer, namely, a side retainer type (see Japanese Unexamined Utility Model Publication No. 6-5870) and a front retainer type (see Japanese Unexamined. Utility Model Publication No. 5-23455 and Japanese Unexamined Patent Publication No. 8-250215).

A typical side retainer type of connector is shown in FIG. 7, and has a retainer 3 mounted in a direction normal to the insertion direction of terminal fittings 2 into a connector housing 1. Accordingly, a retainer insertion hole 4 is open in one side surface of the connector housing 1. This type of prior art connector has an advantage of retaining the terminal fittings 2 with a larger force since the retainer 3 directly locks the terminal fittings 2 as shown in FIG. 8. However, the lateral opening for the insertion of the retainer must be additionally sealed in the case of watertight connectors.

A prior art front retainer type connector is shown in FIG. 9, and has a retainer 5 inserted into a connector housing 6 along the insertion direction of terminal fittings 2. Accordingly, a retainer insertion hole 7 is open in an engaging surface with a mating connector. This type of prior art connector has an advantage that the retainer insertion hole 7 is covered by the mating connector, and therefore is not exposed.

In view of the above, it is an object of the present invention to provide a connector provided with a retainer in which a retainer insertion hole can be covered and terminal fittings can be retained with a large force.

SUMMARY OF THE INVENTION

According to the invention, there is provided a connector provided with a connector housing into which at least one terminal fitting is inserted or insertable. The terminal fitting is retained by a retainer that is inserted or insertable. into the connector housing so as not to come out of the connector housing. The retainer is substantially rotatable about an insertion portion of the retainer or its longitudinal axis between a lock position and an unlock position. The insertion portion comprises at least one lock projection which at least partially projects in a direction intersecting a path or direction of insertion of the terminal fitting and substantially locks the terminal fitting when the retainer is brought to its lock position.

Accordingly, when the retainer is rotated in the connector housing, the position of the lock projection projecting from the insertion portion as a center of rotation is displaced. When the retainer is brought to its lock position, the lock projection faces the terminal fitting in such a direction as to prevent the terminal fitting from coming out. Since the retainer can directly lock the terminal fitting, the terminal fitting can be retained with a large force.

According to a preferred embodiment of the invention, the terminal fitting can be inserted into the connector housing substantially through the rear surface thereof and/or the retainer can be inserted into the connector housing a substantially through the front surface thereof.

Accordingly, since a portion of the connector housing into which the retainer is insertable is provided in the front surface of the connector housing, it is covered by the mating connector, and therefore is not exposed to the outside. In other words, the present invention can provide a connector having advantages of both side retainer type and front retainer type connectors of prior art.

According to a further preferred embodiment, there is provided a connector with a connector housing. At least one terminal fitting is inserted into a rear surface of the connector housing. The terminal is retained by a retainer that is inserted into the connector housing through the front surface thereof. The retainer is rotatable about an insertion portion of the retainer to be inserted into the connector housing between a lock position and an unlock position. The insertion portion comprises a lock projection which projects in a direction intersecting a direction of insertion and locks the terminal fitting when the retainer is brought to its lock position.

Preferably, an insufficiently inserted terminal fitting will interfere with the lock projection to define a rotational or pivotal limit. Accordingly, if an attempt is made to rotate the retainer while the terminal fitting is insufficiently inserted, the terminal fitting interferes with lock projection, with the result that the retainer cannot be rotated to its lock position. Thus, an operator can notice that the terminal fitting is insufficiently inserted.

Further preferably, the retainer comprises an engagement restricting portion which is positionable, and preferably rotatable along the front surface of the connector housing and substantially projectable into an engagement space of the connector housing with a mating connector housing unless the retainer is in its lock position. Accordingly, unless the retainer is in its lock position, the restricting projection interferes the mating connector housing, thereby preventing the connectors from being connected. This prevents an error assembly where the connectors are connected while the retainer is not held in the lock position.

Most preferably, the connector housing comprises one or more cavities into which a corresponding number of terminal fittings are insertable. The lock projection substantially projects into the cavity when the retainer is arranged in its lock position so as to intersect the path or direction of insertion of the terminal fitting.

According to a further preferred embodiment, the connector housing comprises a retainer insertion hole that preferably opens towards a receptacle of the connector housing into which the mating connector housing is insertable. The retainer insertion hole substantially communicates with one or more cavities, into which the terminal fittings are insertable.

Preferably, the retainer insertion hole comprises one or more widened portions which are widened toward the cavities so as not to interfere with the lock projections provided on the retainer when the retainer is turned. The widened portions are preferably so provided as to come to positions corresponding to those of the lock projections when the retainer is substantially fully inserted in the retainer insertion hole.

Further preferably, the retainer and/or the connector housing are provided with positioning means for holding the retainer in its unlock position and/or lock position. Accordingly, an unwanted rotation of the retainer, e.g. during the transportation of the connector can be prevented effectively.

Still further preferably, the connector housing comprises at least one contact wall for contacting a large diameter portion of the retainer to substantially retain the retainer inside the connector housing. Accordingly, the retainer does not come out from the connector housing, e.g. during transportation.

Most preferably, the at least one lock projections are circumferentially spaced about the insertion portion or the longitudinal direction of the retainer at substantially equal spacings, the retainer being preferably rotated by an angle corresponding to about half the circumferential spacing of the lock projections. Accordingly, a very effective locking of the terminal fittings can be achieved, in particular when a plurality of equally and/or symmetrically spaced terminal fittings or cavities for the terminal fittings are provided.

These and other objects, features and advantages of the present invention will become more apparent upon a reading of the following detailed description and accompanying drawings.

DETAILED DESCRIPTION OF THE PREFERRED EMBODIMENT

Figure 1:
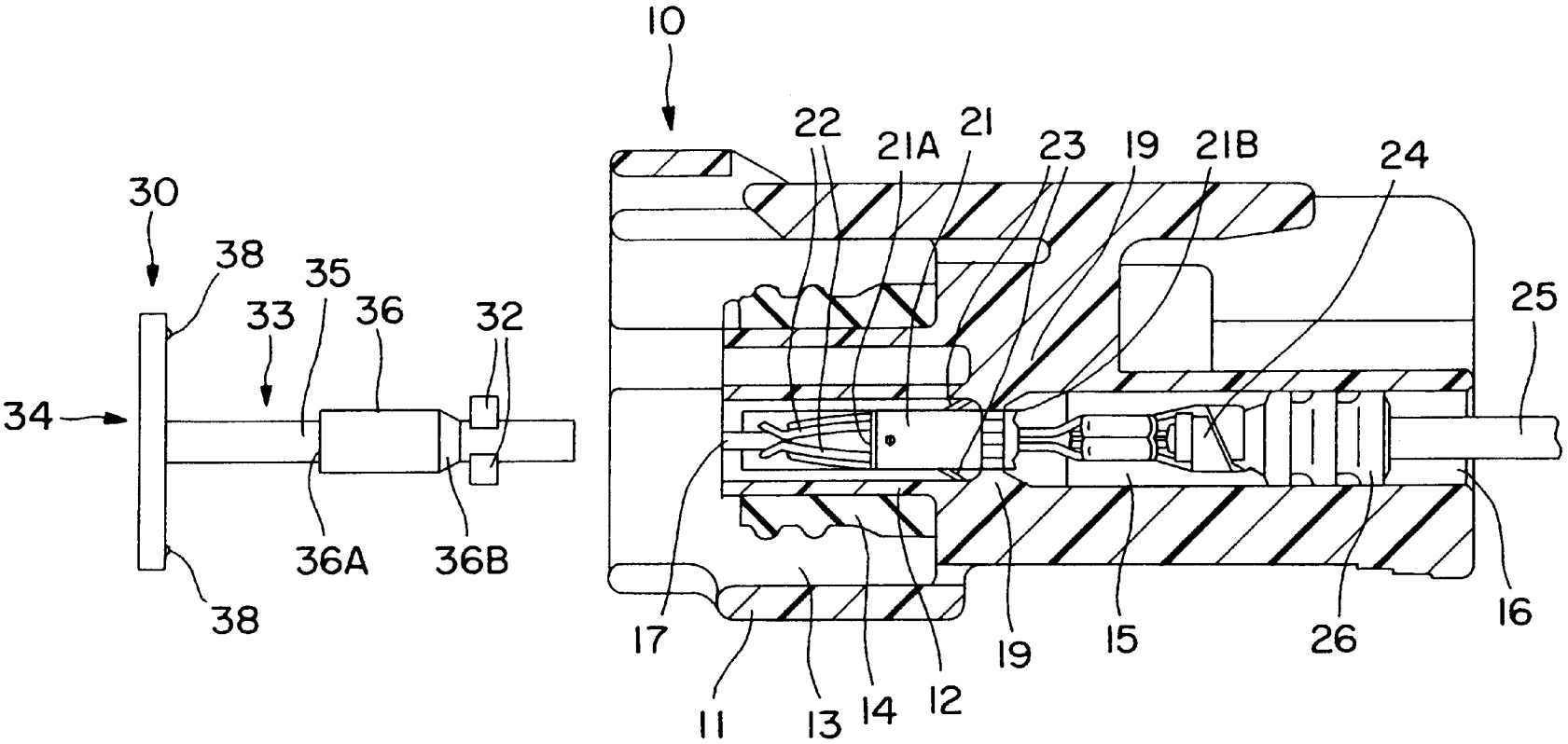
FIG. 1 is a side view in section of a connector provided with a retainer according to one embodiment of the invention.

A connector housing in accordance with one embodiment of the invention is identified by the numeral 10 in FIG. 1. A left end surface of the housing 10 in FIG. 1 is a front surface to be engaged with a mating housing (not shown). A receptacle of the mating housing is insertably fitted or fittable into a space 13 between a receptacle 11 and a housing main body 12. The receptacle 11 projects substantially along an insertion or engaging direction of the mating connector, e.g. substantially forward from the front surface of the housing 10. The housing main body 12 is substantially inside the receptacle 11 for the connection of the two connectors. Further, a waterproof ring 14 is fitted or fittable on the outer surface of the housing main body 12, and is brought or bringable into sealing contact with the inner surface of the mating receptacle and the outer surface of the housing main body 12 preferably by being compressively deformed therebetween.

Inside the housing 10, at least one, and preferably a pair of cavities 15 are provided preferably in the form of through holes extending in engaging direction with the mating connector. The cavities 15 are substantially open in the rear surface of the housing 10, defining terminal insertion openings 16 at the rear of the housing 10, through which terminal fittings 20 are insertable. The cavities 15 are also substantially open in the front surface of the housing 10, defining terminal insertion openings or tab insertion holes 17, through which male tabs (not shown) of the mating connector are insertable to be electrically connected with the terminal fittings 20.

Figure 2:
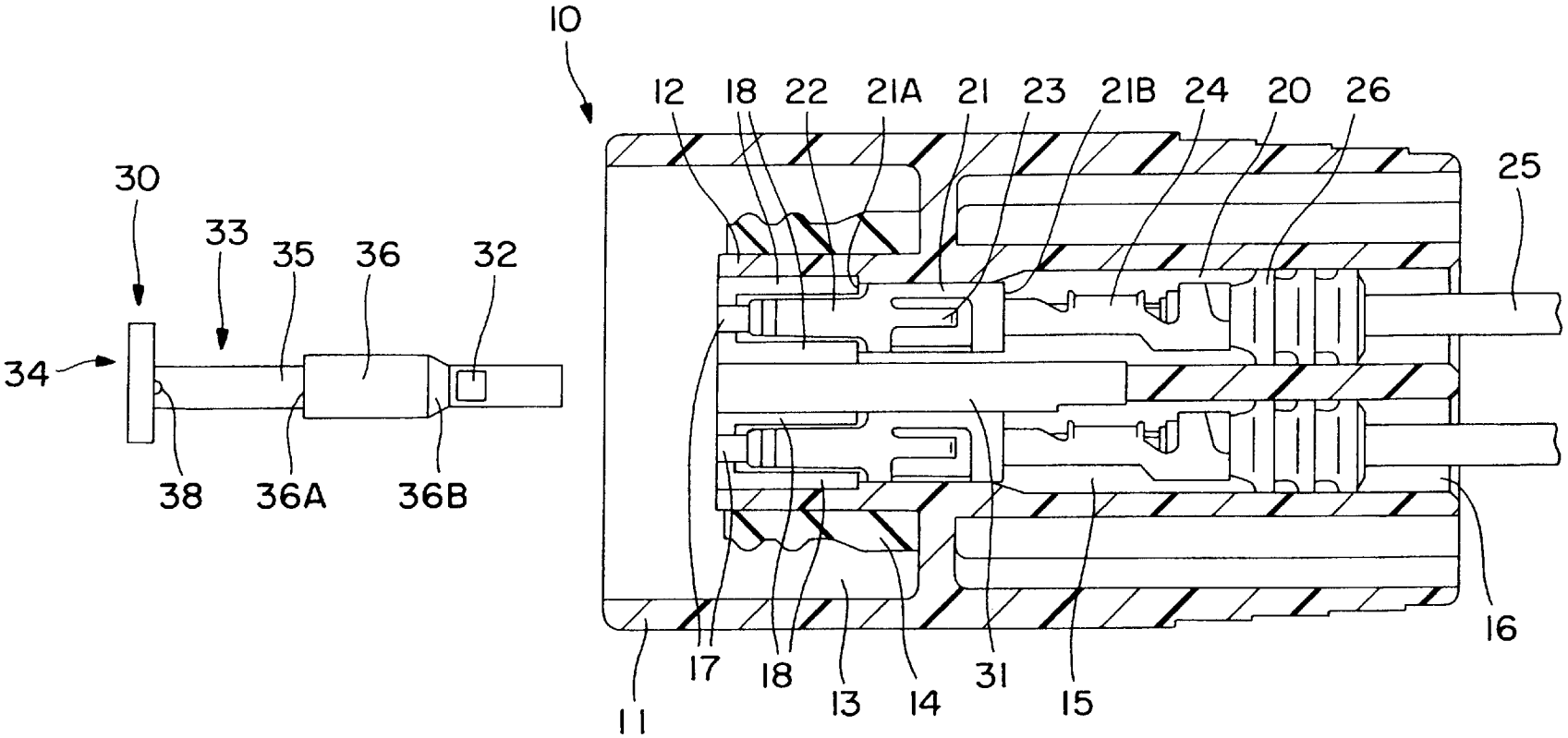
FIG. 2 is a plan view in section of the connector.
Figure 4:
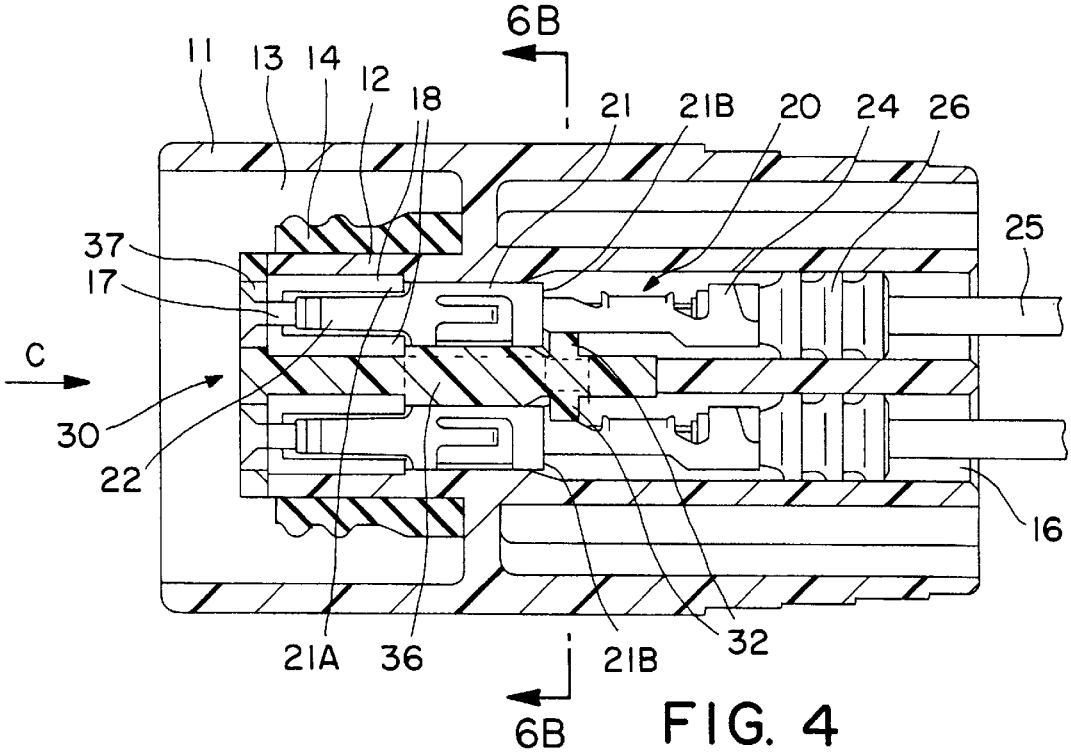
FIG. 4 is a plan view in section of the connector with the retainer in its lock position.

The terminal fittings 20 preferably are formed by successively cutting a conductive metal plate and bending the cut pieces. A front end surface 21A of a main portion 21 is substantially in the form of a rectangular parallelepiped. This front end surface 21A is brought or bringable into contact with a contact wall 18 (see FIG. 2) formed in the cavity 15, thereby substantially positioning the terminal fitting 20 in the cavity 15 with respect to the forward direction. A pair of opposite pieces 22 conveys toward each other (see FIG. 1), and preferably are narrowed along their length (see FIG. 2) so as not to interfere with the contact wall 18 which extends forwardly from the front end surface 21A of the main portion 21. The male tab of the mating connector is held or holdable between these opposite pieces 22 to establish an electrical connection therewith. Further, as shown in FIG. 1, a pair of metal lances or locking portions 23 extend preferably obliquely backward from opposite side walls of the main body 21. These metal locking portions 23 are lockingly engaged or engageable with receiving projections 19 which are formed in the cavity 15 to prevent the terminal fitting 20 from coming out of the cavity 15. In this locked state, a rear end surface 21B of the main portion 21 is located substantially behind the receiving projections 19 as shown in FIG. 1, and a lock projection 32, that is provided on a retainer 30 to be described later, is to be lockingly engaged therewith (see FIG. 4). A barrel portion 24 extends from a center portion of the rear end surface 21B of the main body 21, and preferably does not interfere with the lock projection 32 of the retainer 30. Preferably an end of a wire 25 and a waterproof rubber plug 26 are pressingly connected with the barrel portion 24. This waterproof rubber plug 26 is or can be brought in sealing contact with an external sheath of the wire 25 and/or the inner surface of the cavity 15.

Figure 5A:
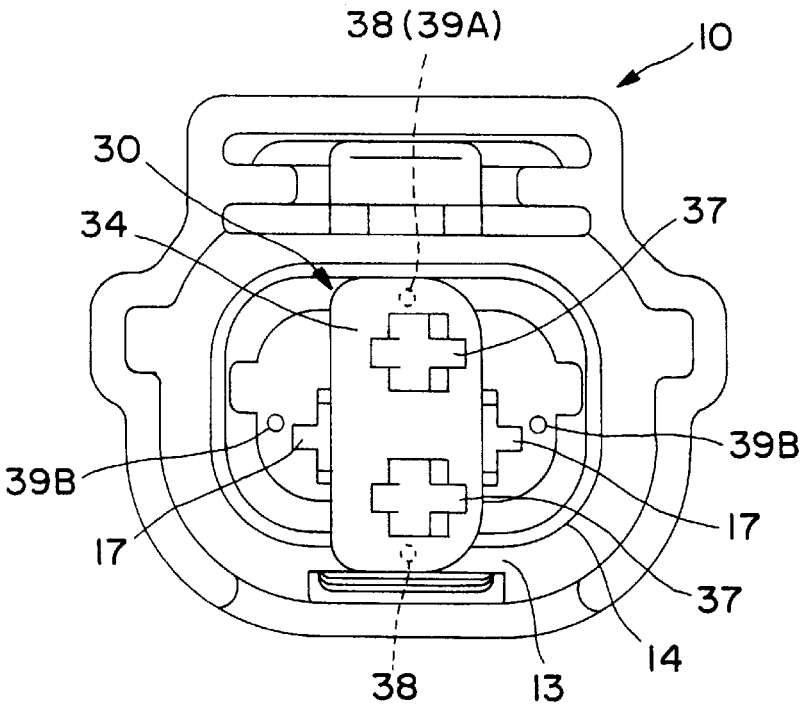
FIG. 5(*a*) is a view from a direction of arrow A of FIG. 3 and FIG. 5(*b*) is a section along 5B—5B of FIG. 3.
Figure 5B:
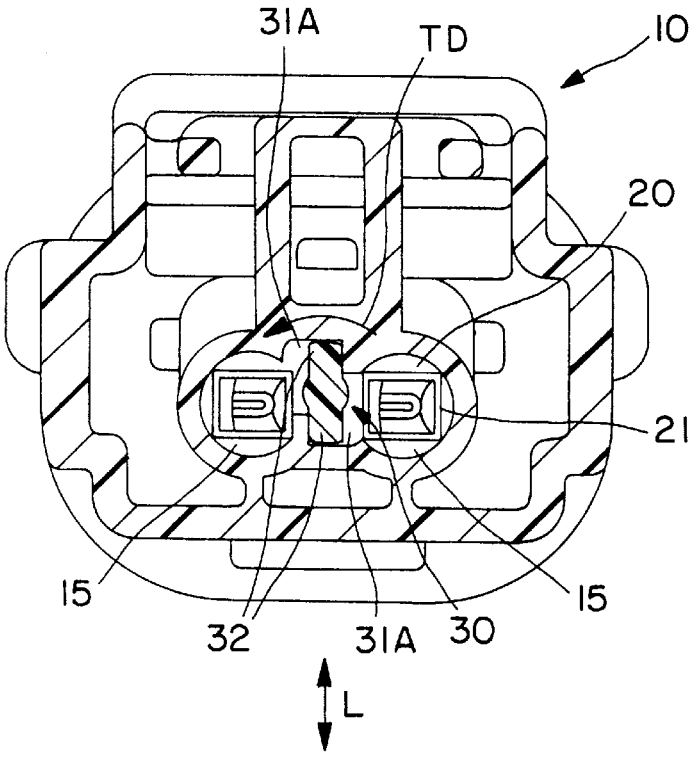

As shown in FIG. 1, a retainer insertion hole 31 in which the retainer 30 is insertably or fittably mountable is formed between the cavities 15 in the housing 10. The retainer insertion hole 31 is open preferably in the front surface of the housing 10. The retainer insertion hole 31, extends to the middle of the housing 10 and substantially communicates with the cavities 15 at their sides. The retainer insertion hole 31 has preferably a substantially asymmetric or rectangular cross section, e.g. by having a longitudinal width in a longitudinal direction L that is larger than a transverse width in a transverse direction T, the longitudinal direction L being arranged at an angle different from 0° or 180°, preferably substantially normal to the transverse direction T. As shown in FIG. 5B, the cross section of the retainer 30 is long or oblong or flattened, preferably along a substantially vertical direction of FIG. 5B and left upper and right lower portions of the retainer insertion hole 31 comprise widened portions 31A, which are widened toward the cavities 15 along a turning direction TD of the retainer 30 so as not to interfere the lock projections 32 provided on the retainer 30 when the retainer 30 is turned.

Figure 3:
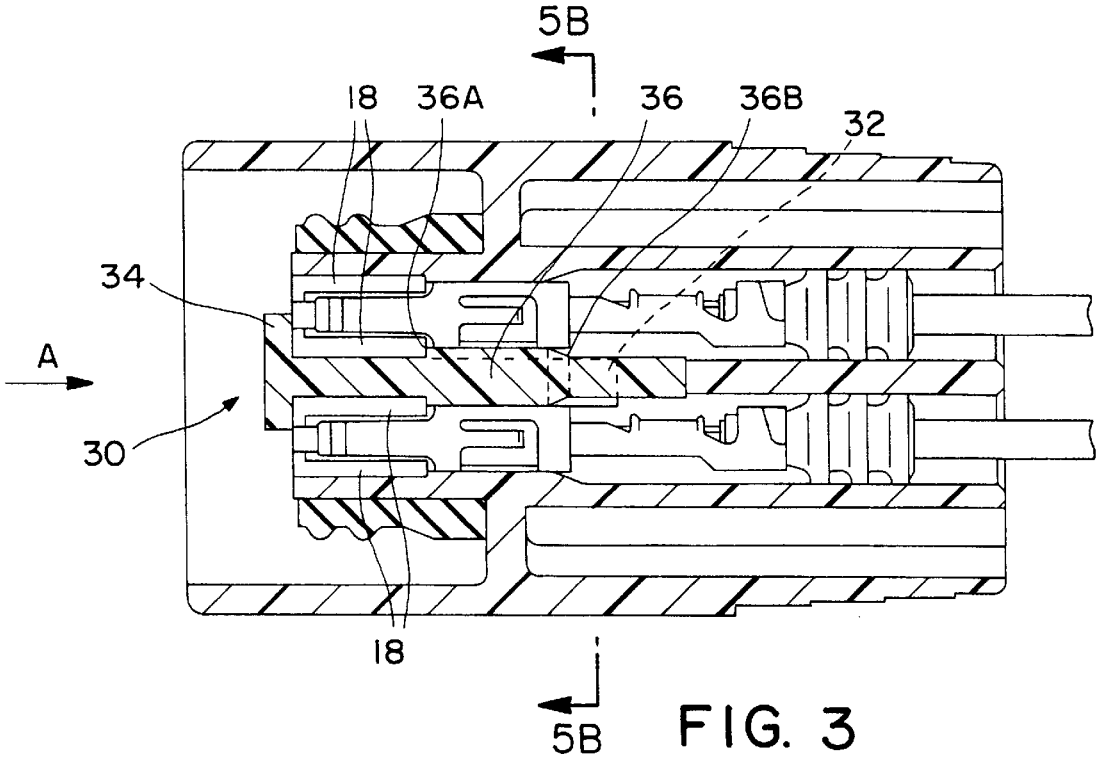
FIG. 3 is a plan view in section of the connector with the retainer in its unlock position.

The retainer 30, as shown in FIG. 1, is comprised of an. insertion portion 33 to be inserted or fitted into the retainer insertion hole 31 and a preferably plate-shaped front cover 34 provided at one end of the insertion portion 33. The insertion portion 33 includes a large diameter portion 36 provided preferably in an intermediate position of a cylindrical member 35 and has a diameter larger than that of the cylindrical member 35. A rear end of the large diameter portion 36 is at an angle different from 0° or 180°, preferably at a substantially right. angle to the cylindrical member 35, thereby forming an angled or substantially vertical surface 36A, and a distal or front end thereof (an end of the large diameter portion 36 to be inserted first in the retainer insertion hole 31) is moderately sloped to the cylindrical member 35, thereby forming a tapered surface 36B. The retainer 30 can forcibly be insertable into the retainer insertion hole 31 by widening the contact walls 18 by the tapered surface 36B. Preferably when the front cover :34 comes into contact with the front surface of the housing main body 12 (see FIG. 3), the large diameter portion 36 moves substantially beyond the contact walls 18 and the rear end surfaces of the contact walls 18 correspond to or face the vertical surface 36A of the large diameter portion 36. In this way, the retainer 30 can rotatably be accommodated in the retainer insertion hole 31 preferably in such a manner as not to come out thereof.

As shown in FIG. 1, at least one, and preferably a pair of lock projections 32 preferably symmetrically project sideways at, the leading end of the large diameter portion 36 of the insertion portion 33. The lock projections 32 are located substantially behind the main portion 21 when the terminal fittings 20 are mounted in their proper positions. The retainer 30 is rotatable between an unlock position (FIG. 5) where the lock projections 32 substantially are aligned along the longitudinal direction L of the cross section of the retainer insertion hole 31 as shown in FIG. 5(*b*) and do not lock the terminal fittings 20 and a lock position (FIG. 6) where they substantially are aligned along the transverse direction T of the retainer insertion hole 31 as shown in FIG. 6(*b*) and substantially project into the cavities 15 to lock the terminal fittings 20.

Figure 6A:
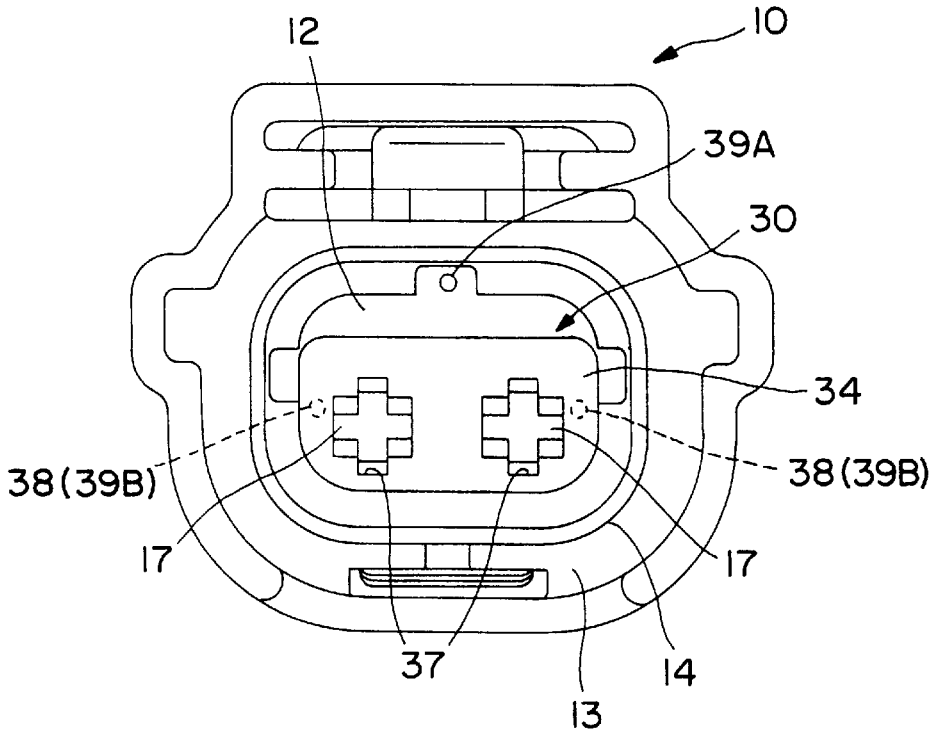
FIG. 6(*a*) is a view from a direction of arrow C of FIG. 4 and FIG. 6(*b*) is a section along 6B—6B of FIG. 4.
Figure 6B:
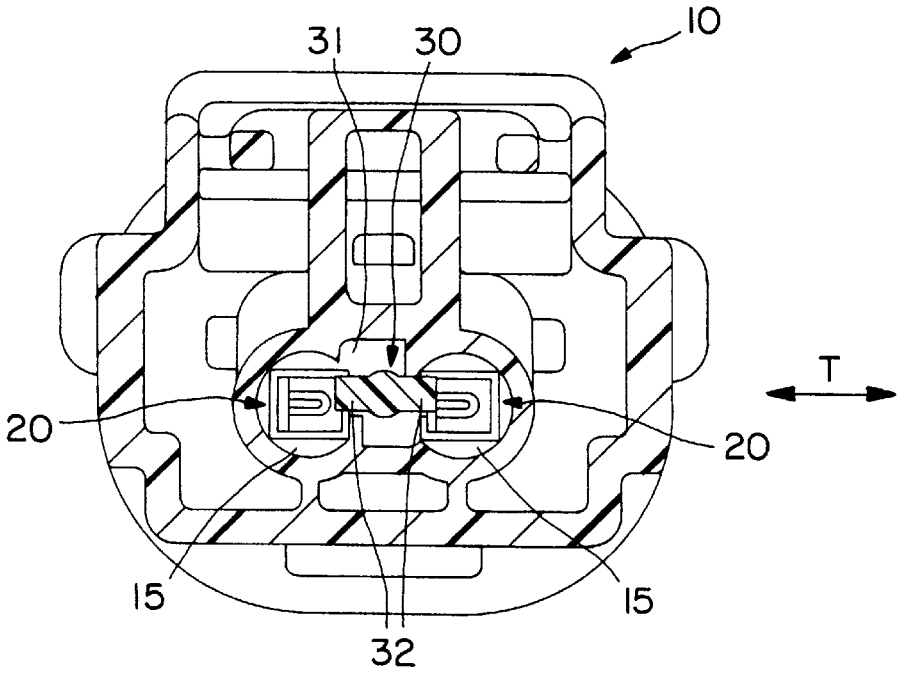
Figure 7:
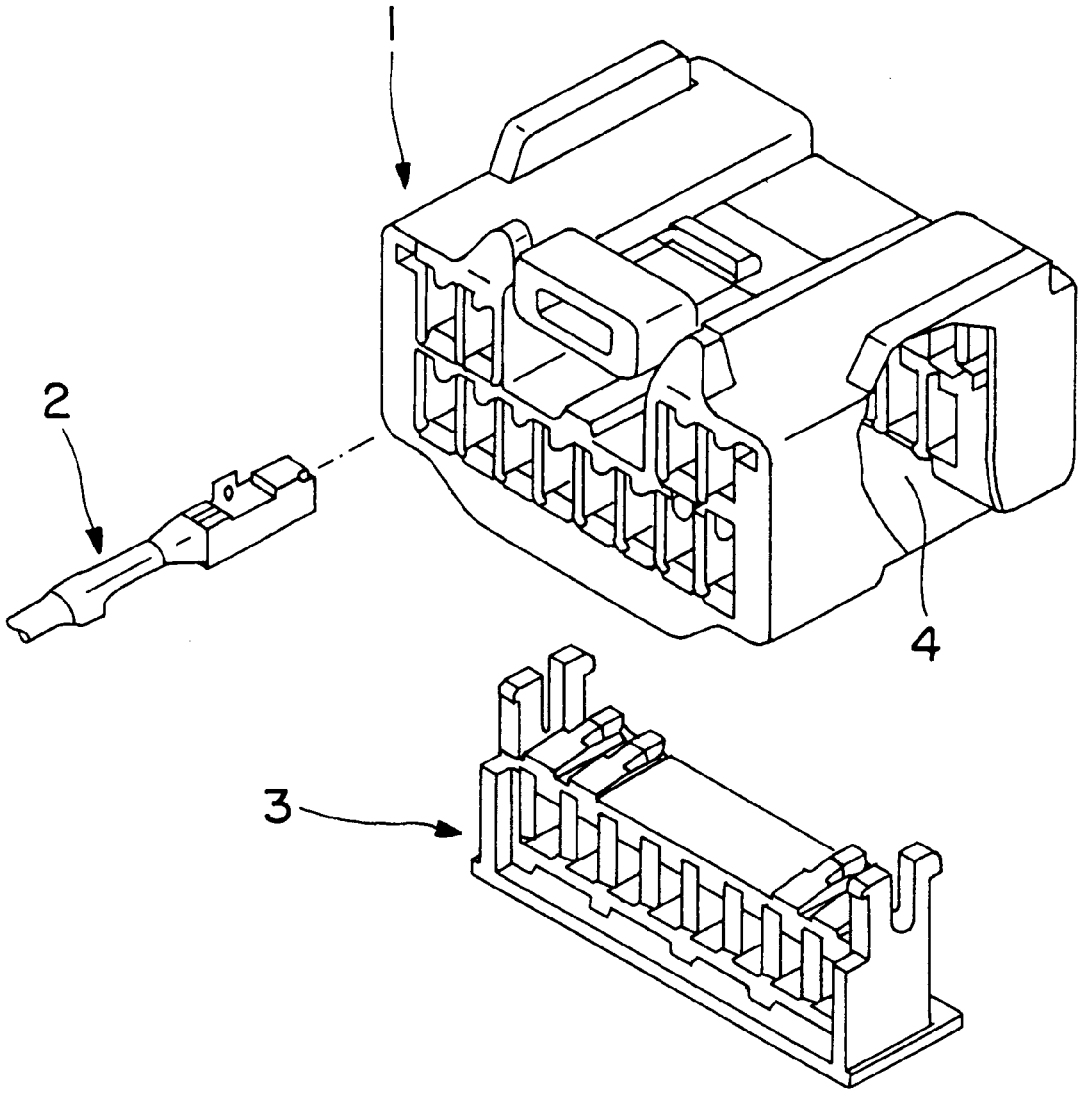
FIG. 7 PRIOR ART
FIG. 7 is a perspective view of a side retainer type connector of prior art.
Figure 8:
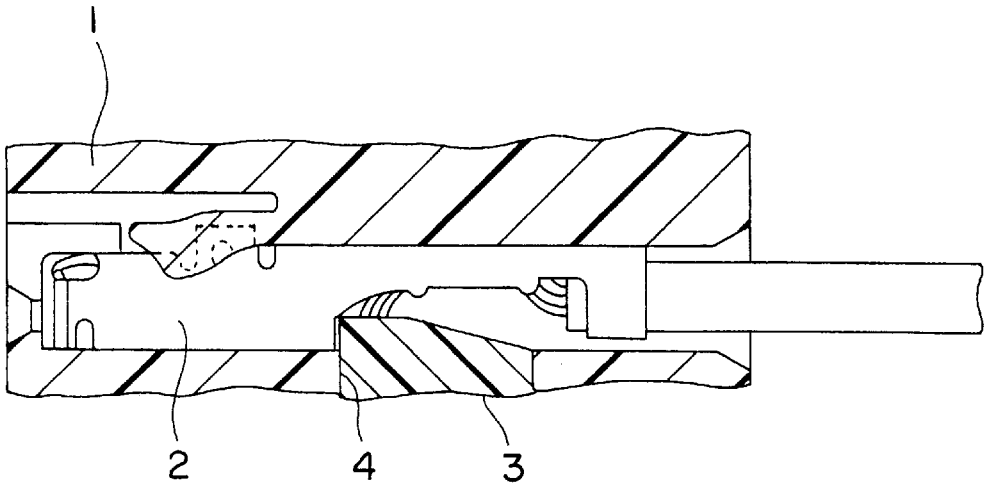
FIG. 8 PRIOR ART
FIG. 8 is a partial section of the side retainer type connector.
Figure 9:
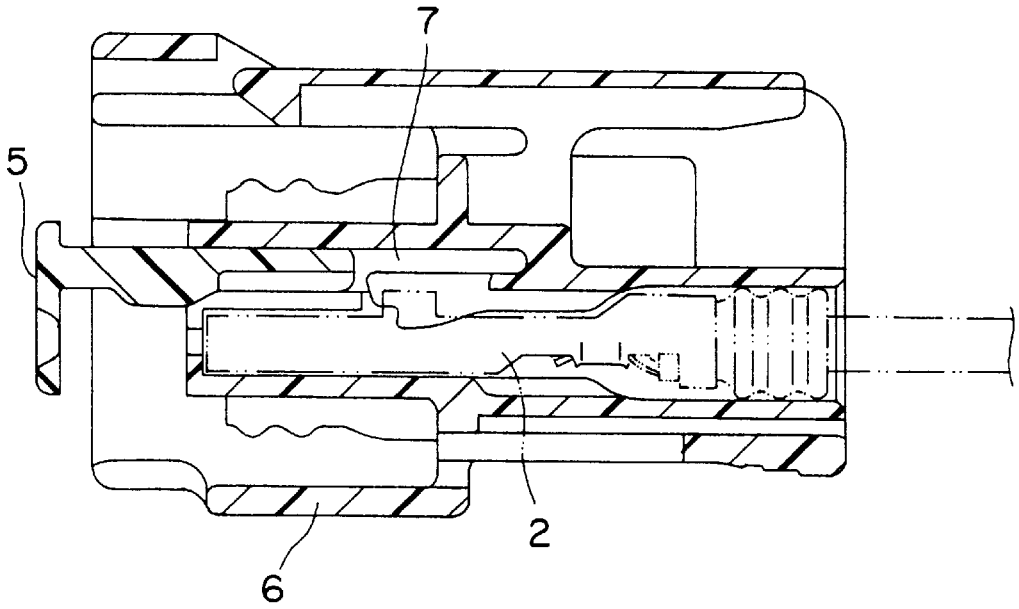
FIG. 9 PRIOR ART
FIG. 9 is a side view in section of a front retainer type connector of prior art.

As shown in FIG. 6(*a*), the front cover 34 preferably has a shape substantially corresponding to the shape of the front surface of the housing main body 12, i.e. a substantially rectangular shape having rounded off corners, and is provided with a pair of through holes 37 substantially corresponding to the tab insertion holes 17, when the retainer 30 is arranged in its lock position (FIG. 6). In the unlock position, as shown in FIG. 5(*a*), the front cover 34 at least partially projects into the space 13 into which the mating connector is fitted or fittable, thereby preventing the engagement of the mating connector. In the lock position, as shown in FIG. 6(*a*), the front cover 34 substantially does not project into the space 13 and the through holes 37 substantially are aligned with the tab insertion openings 17 of the housing main body 12 so as to allow the insertion of the tabs into the cavities 15.

The front cover 34 is formed with one or more, preferably a pair of protuberances 38 projecting toward the front surface of the housing main body 12 as shown in FIG. 1. In the front surface of the housing main body 12 are formed partial lock indentations 39A engageable with the protuberances 38 when the retainer 30 is in its unlock position and full lock indentations 39A engageable with the protuberances 38 when the retainer 30 is in its lock position, so that the retainer 30 is not inadvertently rotated in the respective positions. In other words, the partial lock indentation(s) 39A and the full lock indentation(s) 39B are provided at or on rotationally spaced or distanced positions with respect to each other so that they can interact with the protuberances 38, when the retainer 30 is disposed or arranged in its unlock position (FIG. 5) and lock position (FIG. 6), respectively.

Generally, a connector producing factory and a harness producing factory where terminal fittings connected with ends of wires are assembled into connectors are located in separate places.

In the connector producing factory, the retainers 30 are mounted on the housings 10 in their unlock positions. The connectors are transported in this state to the harness producing factory. Since the retainers 30 are locked so as not to come out by the engagement of the large diameter portions 36 and the contact walls 18, they do not come out of the housing 10 during transportation. Further, the retainers 30 are protected from the contact of other parts by the receptacles 11 and are not inadvertently rotated during transportation preferably due to the engagement of the protuberances 38 of the retainer 30 and the partial lock indentations 39A of the housing main body 12.

In the harness producing factory, the terminal fittings 20 are assembled into this connector. In the connector transported to the harness producing factory, the retainer 30 is in its unlock position and, therefore, the lock projections 32 do not project into the cavities 15 (see FIG. 5(*b*)). The terminal fittings 20 may be pushed into the cavities 15 with the connector in this state. During the insertion, the metal locking portions 23 of the terminal fitting 20 are deformed toward the outer surface of the terminal fitting 20 by the receiving projections 19 (see FIG. 1). When the terminal fitting 20 is pushed further, the metal locking portions 23 are restored to their original shape upon moving beyond the receiving projections 19, thereby lockingly engaging the receiving projections 19. This is referred to as primary locking. At this time, the main portion 21 of the terminal fitting 20 comes into contact with the contact wall 18 (see FIG. 3) of the cavity 15, thereby being substantially positioned with respect to an insertion or forward direction.

In this state, the front cover 34 of the retainer 30 is rotated about its longitudinal axis (or about the insertion portion 33), e.g. clockwise of FIG. 5. Then, the protuberances 38 of the front cover 34 are substantially disengaged from the partial lock indentations 39A and, when the through holes 37 of the front cover 34 are substantially aligned with the tab insertion openings 17, the retainer 30 preferably is located in its lock position (see FIG. 6(*a*)) where the protuberances 38 are engaged lockingly with the full lock indentations 39B. Inside the housing 10, the lock projections 32 of the retainer 30 face the rear end surfaces 21B of the main portions 21 of the terminal fittings 20 (see FIGS. 4 and 6(*b*)), and the terminal fittings 20 are locked directly by the retainer 30 (secondary locking). Here, if the terminal fittings 20 are insufficiently inserted, the locking projections 32 of the retainer 30 cannot be located behind the main bodies 21 of the terminal fittings 20 and, accordingly, the retainer 30 cannot be turned because of the lock projections 32 interacting with or interfering the terminal fittings 20. This makes the insufficient insertion of the terminal fittings 20 detectable.

When this connector is engaged with a mating connector, tabs of the mating connector are inserted into the cavities 15 to be electrically connected, and the interiors of the cavities 15 are held watertight by the waterproof ring 14 provided between the connectors and the waterproof rubber plugs 26 in the cavities 15. Here, unless the retainer 30 is in its lock position, the mating connector cannot be fitted or fittable into the space 13 since the front cover 34 projects into the space 13 (see FIG. 5(*a*)), with the result that an error assembly can be prevented.

In this way, according to the connector of this embodiment, the terminal fittings 20 can be retained with a strong force since they are directly locked by the retainer 30. Further, since the retainer insertion openings 31 are formed in the front surface of the housing 10, they are not exposed to the outside by being covered by the mating connector. In other words, the connector of this embodiment has advantages of both side retainer type and front retainer type connectors of prior art and can retain the terminal fittings 20 with a large force while being designed to be watertight.

The present invention is not limited to the described and illustrated embodiment, but the following embodiments are also embraced by the technical scope of the present invention as defined in the claims. Besides the following embodiments, a variety of other changes can be made without departing from the scope and spirit of the invention as defined in the claims.

Although the present invention is applied to the watertight connector in the foregoing embodiment, it may be applied to non-watertight connectors.

Although two terminal fittings 20 are accommodated in the connector of the foregoing embodiment, the number of the terminal fittings may be 1 or 3 or more. In such a case, the retainer may be provided with lock projections and/or through holes in conformity with the number of the terminal fitting(s).

The plurality of lock projections may be arranged at substantially equal angular spacings or positions or pitches (i.e. when three lock projections are provided, the angle defined therebetween may be about 120°, when four lock projections are provided, the angle defined therebetween may be about 90°, when five lock projections are provided, the angle defined therebetween may be about 72°, etc.).

In the foregoing embodiment the lock and unlock positions of the retainer were rotationally displaced by about 90°, but other rotational displacements or angles may be possible. Preferably, the rotational displacement corresponds to about half the angle or angular spacing or distance between the lock projections (e.g. if the angle between two adjacent lock projections is 120°, the rotational displacement of the retainer, that is between the lock and unlock positions is preferably about 60°).

What is claimed is:

1. A connector provided with a retainer (30) in which at least one terminal fitting (20) inserted into a connector housing (10) is retained by the retainer (30) inserted into the connector housing (10) so as not to come out of the connector housing (10), wherein:

the retainer (30) is substantially rotatable about an insertion portion (33) thereof between a lock position and an unlock position, and the insertion portion (33) is disposed in the connector housing (10) and comprises at least one lock projection (32) which projects at least partially in a direction intersecting a path of insertion of the terminal fitting (20) and substantially locks the terminal fitting (20) when the retainer (30) is brought to its lock position.

2. A connector according to claim 1, wherein the terminal fitting (20) is insertable into the connector housing (10) substantially through a rear surface thereof and the retainer (30) is insertable into the connector housing (10) substantially through a front surface thereof.

3. A connector according to claim 1, wherein the terminal fitting (20) interferes with a rotational range of the lock projection (32) when the terminal fitting (20) is inserted insufficiently.

4. A connector according to claim 3, wherein the retainer (30) comprises an engagement restricting portion (34) which is positionable at, and rotatable along a front surface of the connector housing (10) and projectable into an engagement space (13) of the connector housing (10) with a mating connector housing unless the retainer (30) is in its lock position.

5. A connector according to claim 3, wherein the connector housing (10) comprises at least one cavity (15) into which a corresponding number of the terminal fittings (20) are insertable, the lock projection (32) substantially projecting into the cavity (15) when the retainer (30) is arranged in its lock position so as to intersect the path of insertion of the terminal fitting (20).

6. A connector according to claim 1, wherein the connector housing (10) comprises a retainer insertion hole (31) open towards a receptacle (11) of the connector housing (10) into which the mating connector housing is insertable, the retainer insertion hole (31) substantially communicating with at least one cavity (15) into which the terminal fitting (20) is insertable.

7. A connector according to claim 6, wherein the retainer insertion hole (31) comprises at least one widened portion (31A) widened toward the cavity (15) so as not to interfere the lock projections (32) provided on the retainer (30) when the retainer (30) is turned, wherein the widened portion (31A) is provided to come to positions corresponding to those of the lock projections (32) when the retainer (30) is substantially fully inserted in the retainer insertion hole (31).

8. A connector according to claim 1, wherein the retainer (30) and the connector housing (10) are provided with positioning means (38; 39A, 39B) for holding the retainer (30) in its unlock position and lock position.

9. A connector according to claim 1, wherein the connector housing (10) comprises at least one contact wall (18) for contacting in particular a large diameter portion (36) of the retainer (30) to substantially retain the retainer (30) inside the connector housing (10).

10. A connector according to claim 1, wherein the at least one lock projections (32) comprises a plurality of lock projections (32) which are circumferentially spaced about the insertion portion (33) at substantially equal spacings, the retainer (30) being rotatable by an angle corresponding to half the circumferential spacing of the lock projections (32).

* * * * *